US009624033B1

(12) United States Patent
Price et al.

(10) Patent No.: US 9,624,033 B1
(45) Date of Patent: Apr. 18, 2017

(54) BOLT-ON SHAFT AND GEAR SYSTEM FOR GRASPING STRUCTURE

(75) Inventors: Thomas L. Price, Valley Head, AL (US); Michael Shane Peek, Pisgah, AL (US)

(73) Assignee: The Heil Co., Chattanooga, TN (US)

( * ) Notice: Subject to any disclaimer, the term of this patent is extended or adjusted under 35 U.S.C. 154(b) by 885 days.

(21) Appl. No.: 11/931,981

(22) Filed: Oct. 31, 2007

(51) Int. Cl.
*B65B 21/02* (2006.01)
*B65F 3/02* (2006.01)

(52) U.S. Cl.
CPC .... *B65F 3/0213* (2013.01); *B65F 2003/0279* (2013.01)

(58) Field of Classification Search
CPC ..... B65F 3/00
USPC ..... 74/640
See application file for complete search history.

(56) References Cited

U.S. PATENT DOCUMENTS

| | | | | |
|---|---|---|---|---|
| 4,461,607 | A * | 7/1984 | Smith | 414/406 |
| 5,020,844 | A * | 6/1991 | Pickrell | 294/86.4 |
| 5,209,537 | A * | 5/1993 | Smith et al. | 294/111 |
| 5,711,565 | A * | 1/1998 | Smith et al. | 294/88 |

FOREIGN PATENT DOCUMENTS

| | | |
|---|---|---|
| CA | 2358737 | 4/2002 |

* cited by examiner

*Primary Examiner* — Saul Rodriguez
*Assistant Examiner* — Willie Berry, Jr.
(74) *Attorney, Agent, or Firm* — Harness, Dickey & Pierce, P.L.C.

(57) ABSTRACT

A bolt-on shaft and gear system includes a body assembly defining two spaced apart mounts. A powered grasping assembly includes a first pivot pin pivotally positioned in a first of the two mounts and a first gear section fixedly coupled to the first pivot pin. An actuating driver is attached between the body assembly and the powered grasping assembly for controllably rotating the powered grasping assembly about the first pivot pin. A follower grasping assembly includes a second pivot pin pivotally positioned in a second of the two mounts and a second gear section fixedly coupled to the second pivot pin, the second gear section is meshed with the first gear section so as to rotate with the powered grasping assembly in an opposite direction.

9 Claims, 11 Drawing Sheets

BOLT-ON SHAFT AND GEAR SYSTEM FOR GRASPING STRUCTURE

FIELD OF THE INVENTION

This invention relates to grasping structures for refuse collection vehicles and the like and more specifically to a bolt-on shaft and gear system for operating a grasping structure.

BACKGROUND OF THE INVENTION

In the refuse collection industry, an articulated arm includes a pair of grasping members mounted for opposed movement to grasp smaller containers and lift and empty the containers into a larger collection vehicle. At least one of the grasping members is driven by a remotely controllable driver and, generally, the closing and opening movements of the pair of grasping members are accomplished by a gear welded to the inner end of each member with the two gears meshing to produce opposed movements in response to movement of the driven member. Because of the enormous amount of use to which the grasping members are subjected, the gears wear relatively rapidly and must be changed quite often. One problem is that because the gears are welded in place to provide the required amount of strength, changing the gears is very difficult, time consuming, and in some instances requires a complete change of one or more of the grasping members. Thus, changing the gears is very expensive and generally requires a relatively long down-time for the collection vehicle, which adds extensively to the inconvenience and expense.

In addition to the above, the process of welding the gears onto the members can result in poor alignment, which further enhances the wear. Also, welding can be haphazard if not closely monitored so that cracks, etc. can develop greatly reducing the durability of the entire grabber structure.

It would be highly advantageous, therefore, to remedy the foregoing and other deficiencies inherent in the prior art.

Accordingly, it is an object of the present invention to provide a new and improved bolt-on shaft and gear system for operating a grasping structure.

Another object of the invention is to provide a new and improved bolt-on shaft and gear system with improved durability and alignment.

And another object of the invention is to provide a new and improved bolt-on shaft and gear system that is substantially easier to service and/or repair.

Still another object of the present invention is to provide a new and improved bolt-on shaft and gear system for operating a grasping structure that is easy to install on substantially any collection vehicle.

SUMMARY OF THE INVENTION

Briefly, to achieve the desired objects of the instant invention in accordance with a preferred embodiment thereof, provided is a bolt-on shaft and gear system for operating a grasping structure. A bolt-on shaft and gear system includes a body assembly defining two spaced apart mounts. A powered grasping assembly includes a first pivot pin pivotally positioned in a first of the two mounts and a first gear section fixedly coupled to the first pivot pin. An actuating driver is attached between the body assembly and the powered grasping assembly for controllably rotating the powered grasping assembly about the first pivot pin. A follower grasping assembly includes a second pivot pin pivotally positioned in a second of the two mounts and a second gear section fixedly coupled to the second pivot pin, the second gear section is meshed with the first gear section so as to rotate with the powered grasping assembly in an opposite direction.

In one embodiment, a bolt-on shaft and gear system includes an elongated body assembly defining two spaced apart mounts. The body assembly includes a metal body and a pair of elongate mounting plates affixed to opposite sides of the body. The body assembly is constructed with a first of the two mounts positioned adjacent a distal end and the second of the two mounts positioned between the distal end and a proximal end. A powered grasping assembly includes a first pivot pin, a first gear section, and a mounting block, the first gear section being fixedly attached to the mounting block, and the first pivot pin being removably fixed in the mounting block. An actuating driver is attached to an anchor on the body assembly and to an anchor on the powered grasping assembly for controllably rotating the powered grasping assembly about the first pivot pin. The powered grasping assembly further includes a first mounting pad positioned to receive a first grasping arm fixedly attached thereto for rotation with the powered grasping assembly and a follower grasping assembly includes a second pivot pin pivotally positioned in a second of the two mounts and a second gear section fixedly coupled to the second pivot pin. The second gear section is meshed with the first gear section so as to rotate with the powered grasping assembly in an opposite direction. The follower grasping assembly further includes a second mounting pad positioned to receive a second grasping arm fixedly attached thereto for rotation with the follower grasping assembly. At least one connecting member is positioned on the body assembly for attaching the body assembly to a grasping structure including articulated arms connected to a refuse collection vehicle.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE DRAWINGS

Figure 1:
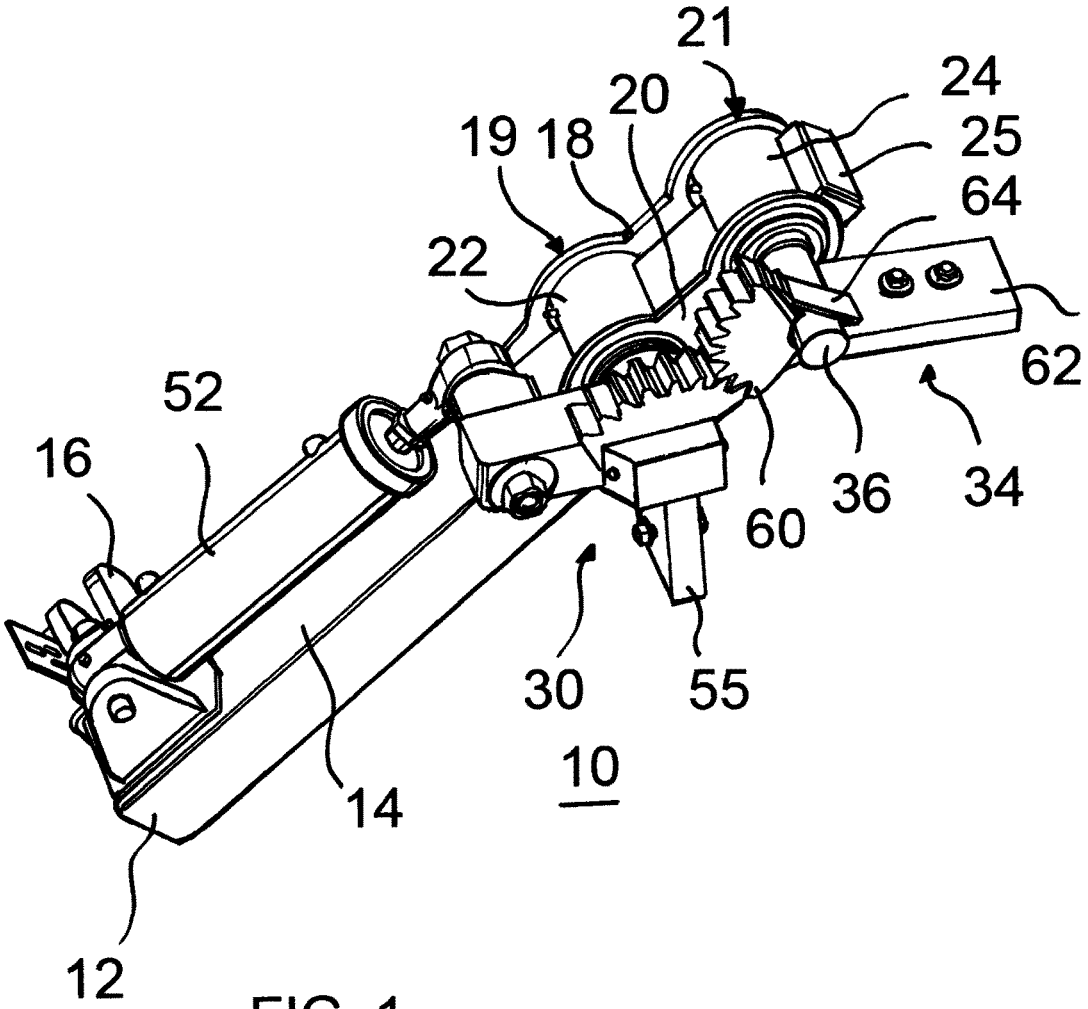
FIGS. 1-4 are perspective views taken from different angles of a bolt-on shaft and gear system for operating a grasping structure incorporating an embodiment of the present invention.
Figure 2:
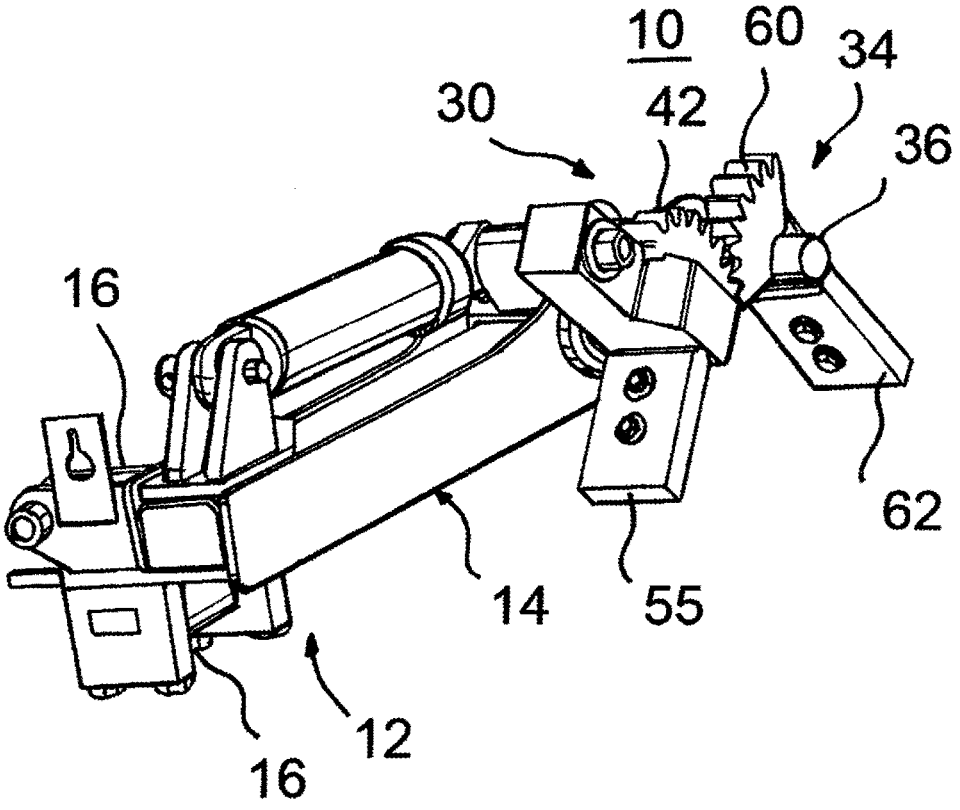
Figure 3:
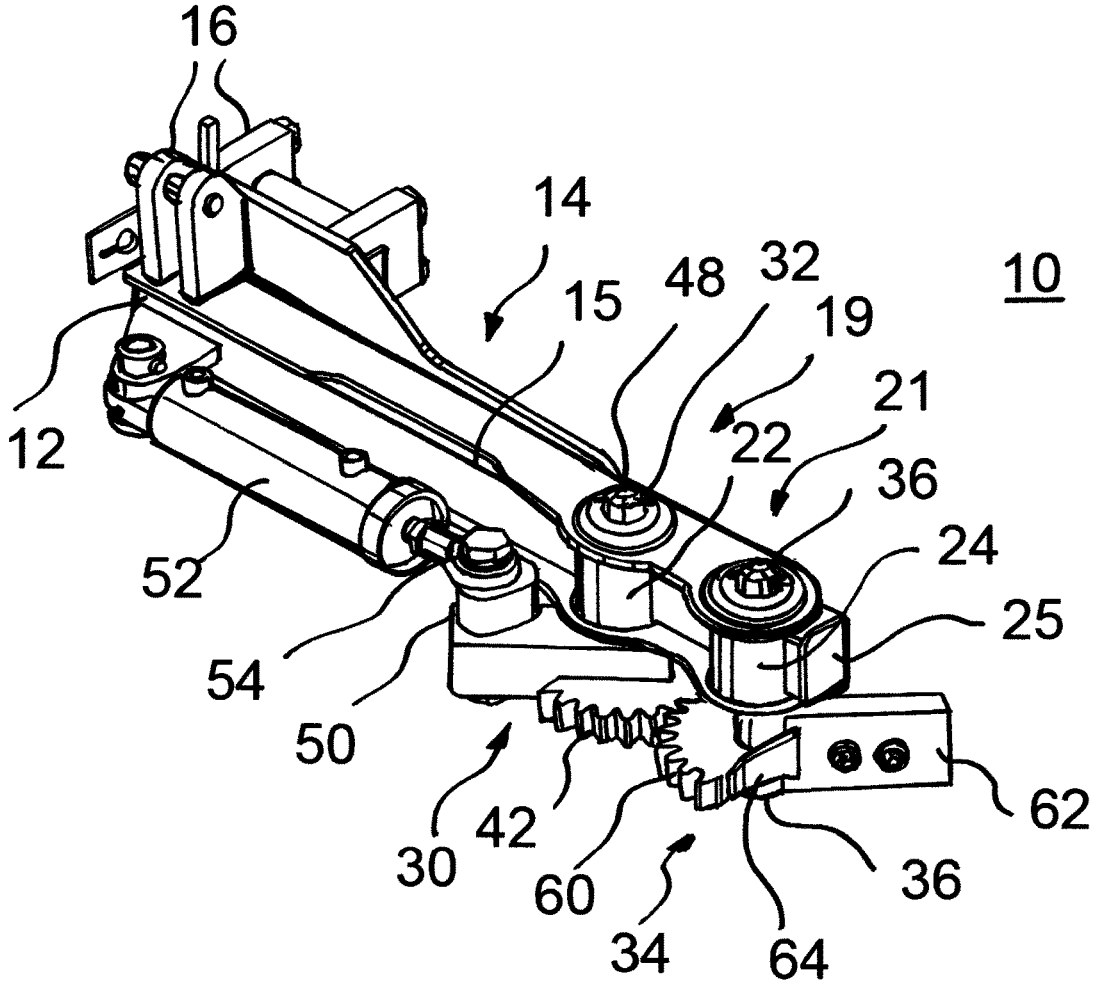
Figure 4:
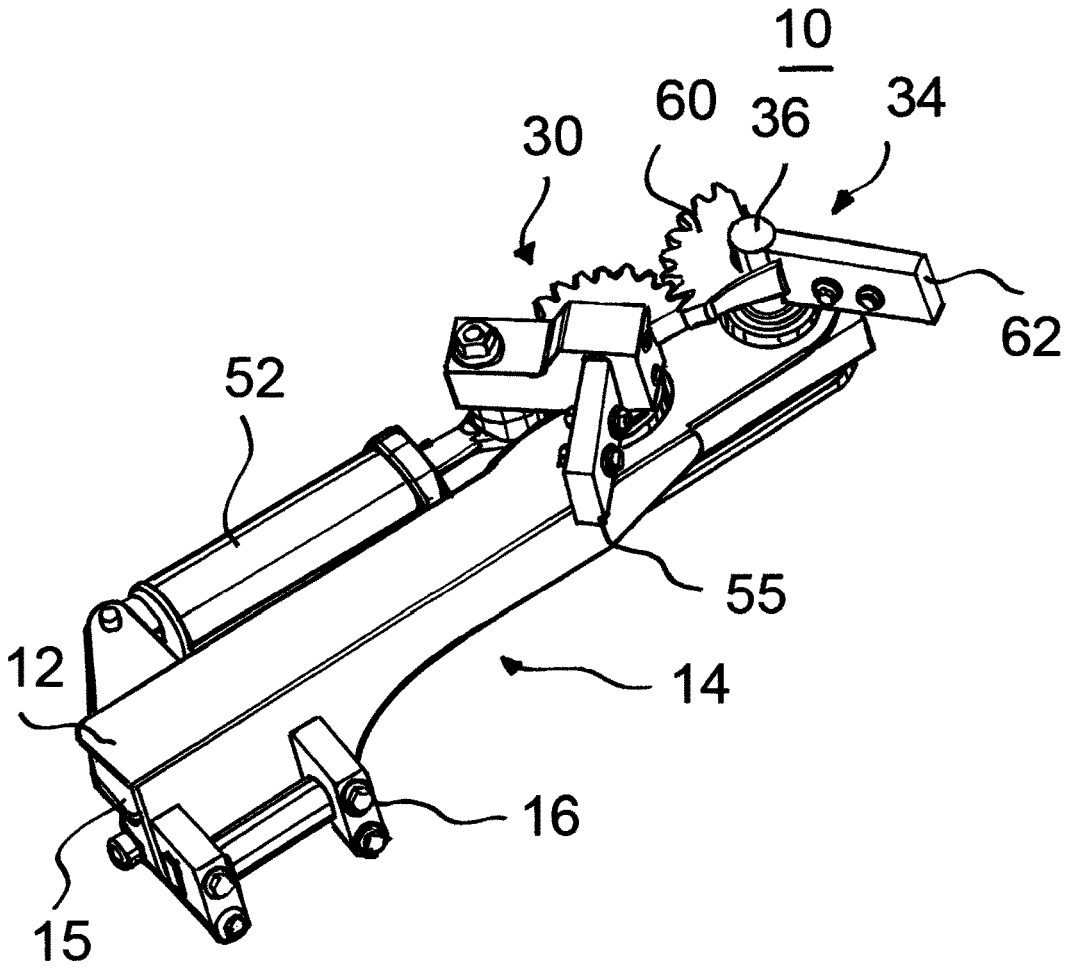
Figure 5:
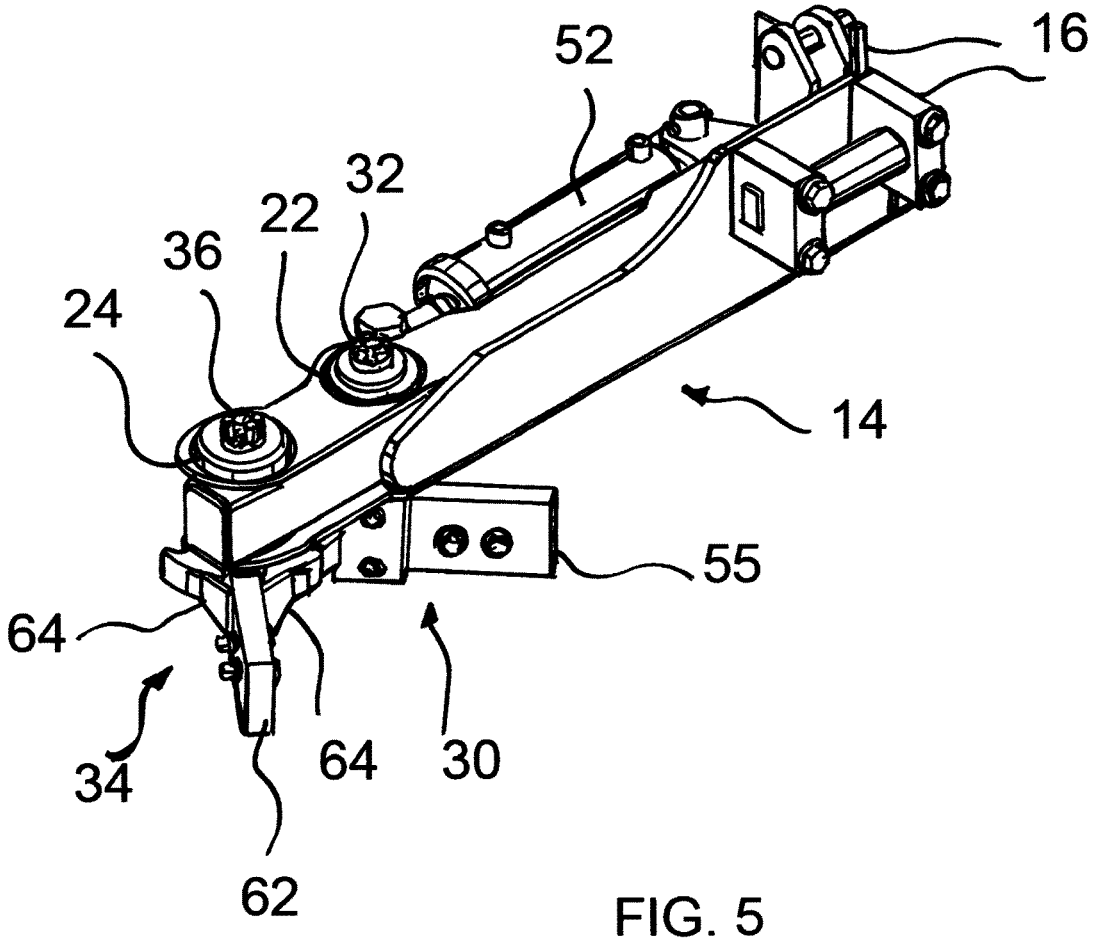
FIG. 5 is a bottom perspective view of the bolt-on shaft and gear system of FIG. 1.
Figure 6:
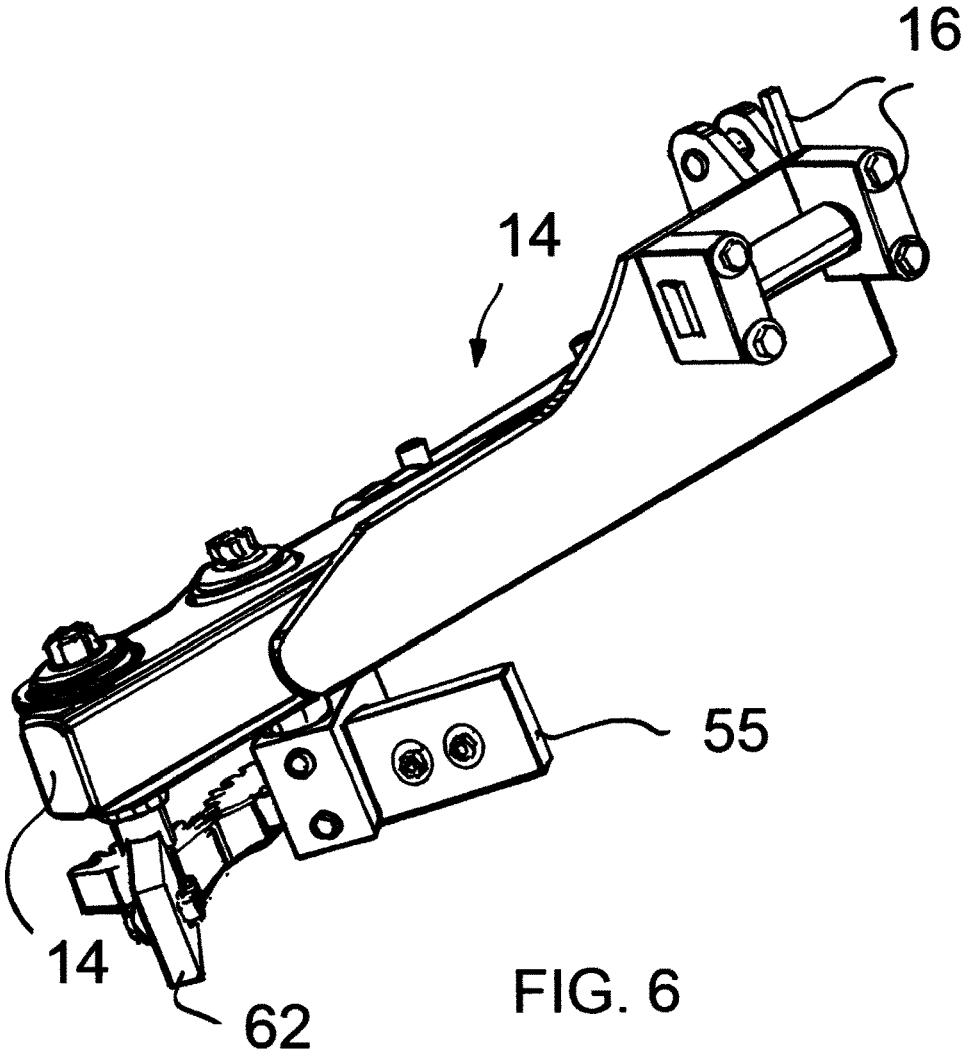
FIG. 6 is a side perspective view of the bolt-on shaft and gear system of FIG. 1.

Turning now to the drawings, attention is first directed to FIGS. 1-6, each of which illustrate, from various positions and angles, a bolt-on shaft and gear system, generally designated 10, in accordance with the present invention. Bolt-on shaft and gear system 10 is a portion of a grasping structure which may include any of the well known articulated arms connected to refuse collection vehicles or the like or, in some specific applications may be connected directly to a vehicle or other structure at a proximal end 12. Bolt-on shaft and gear system 10 includes an elongated body assembly 14 which in this embodiment includes a body 15 having a square or rectangular cross-section and is solid metal to provide the desired rigidity and durability. Several connecting members 16 are provided at proximal end 12 of body assembly 14 for connecting bolt-on shaft and gear system 10 into a grasping structure, not shown in detail. The specific construction of members 16 is not part of the invention and will be understood by those skilled in the art and, therefore, will not be described in detail herein.

A pair of elongated mounting plates 18 and 20 are affixed to opposite sides of body 15 by any convenient means, such as welding, bolting, etc. For purposes of this disclosure, mounting plates 18 and 20 are considered to be part of body assembly 14. Mounting plates 18 and 20 each have a pair of spaced apart openings formed therein and positioned to be axially aligned. As can be seen best in FIGS. 1 and 3, body 15 has two spaced apart transversely extending channels formed therein in alignment with the openings in mounting plates 18 and 20 to form mounts, generally designated 19 and 21, for a pair of bearing blocks 22 and 24. Mount 21 is positioned at the distal end, designated 25, of bolt-on shaft and gear system 10 and second mount 19 is spaced inwardly toward proximal end 12. Bearing blocks 22 and 24 have cylindrical openings therethrough that are accessible through the openings in mounting plates 18 and 20. It will of course be understood that the disclosed structure is used because of the convenience in manufacturing and assembly but other embodiments could be devised, such as mounting the bearing blocks directly in openings through body 15. For purposes of this disclosure, mounts 19 and 21 are considered to include openings or channels in body 15 and plates 18 and 20 as well as any bearings, bearing blocks, etc. positioned along body assembly 14 to receive pivot pins therein.

Figure 7:
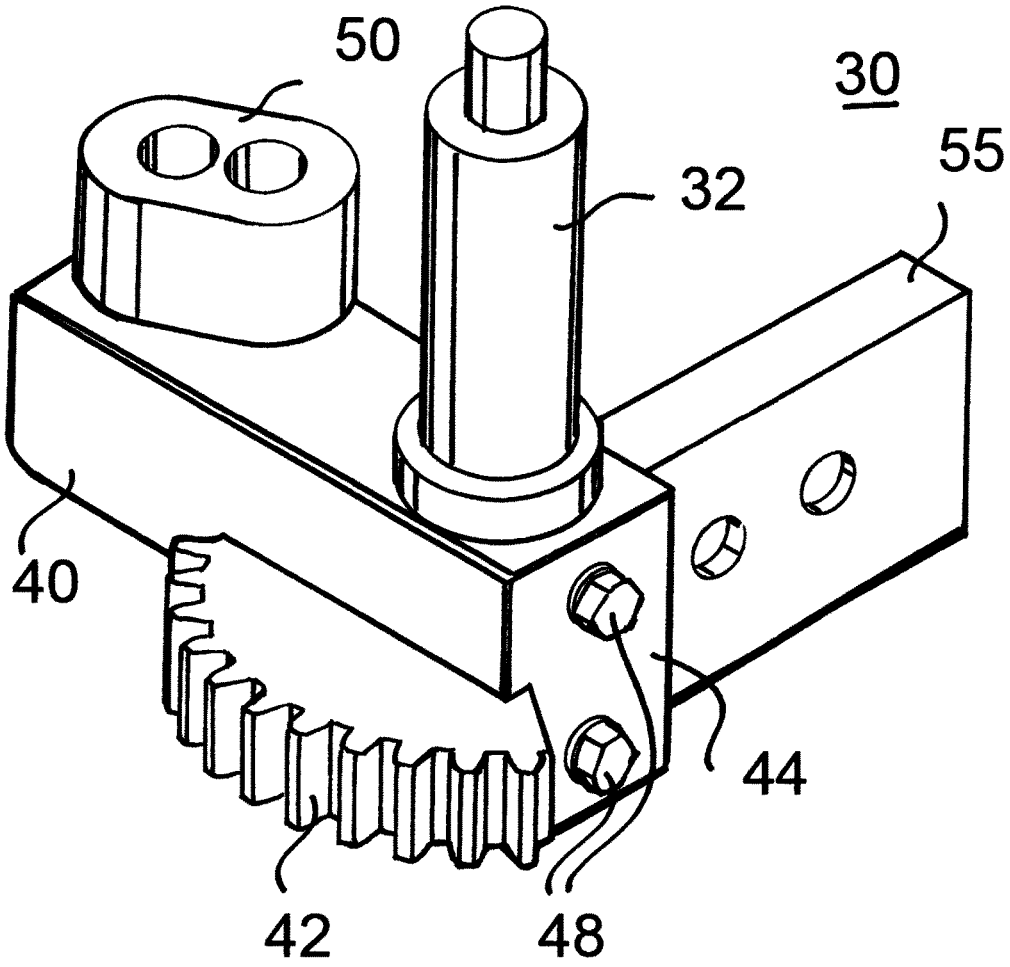
FIGS. 7-10 are perspective views taken from different angles of a portion of the bolt-on shaft and gear system of FIG. 1.
Figure 8:
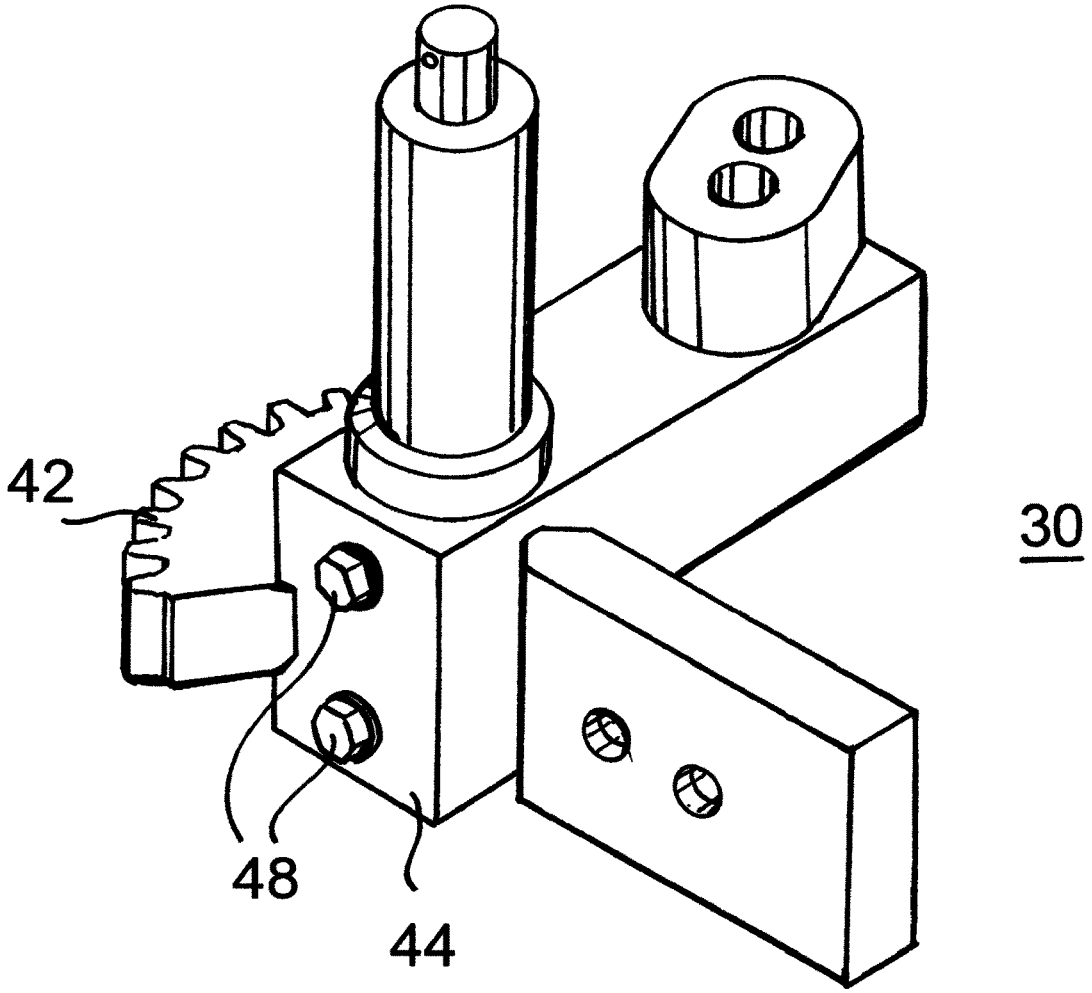
Figure 9:
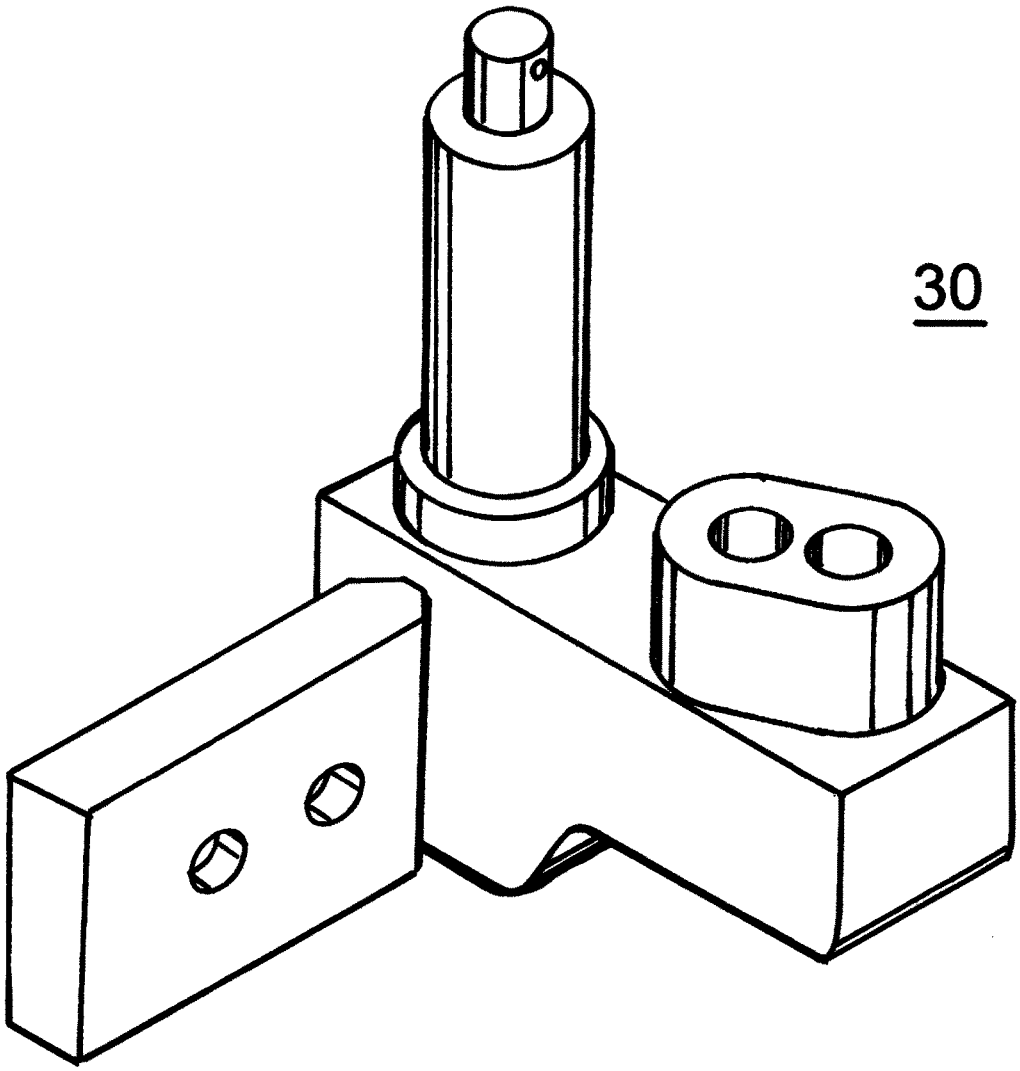
Figure 10:
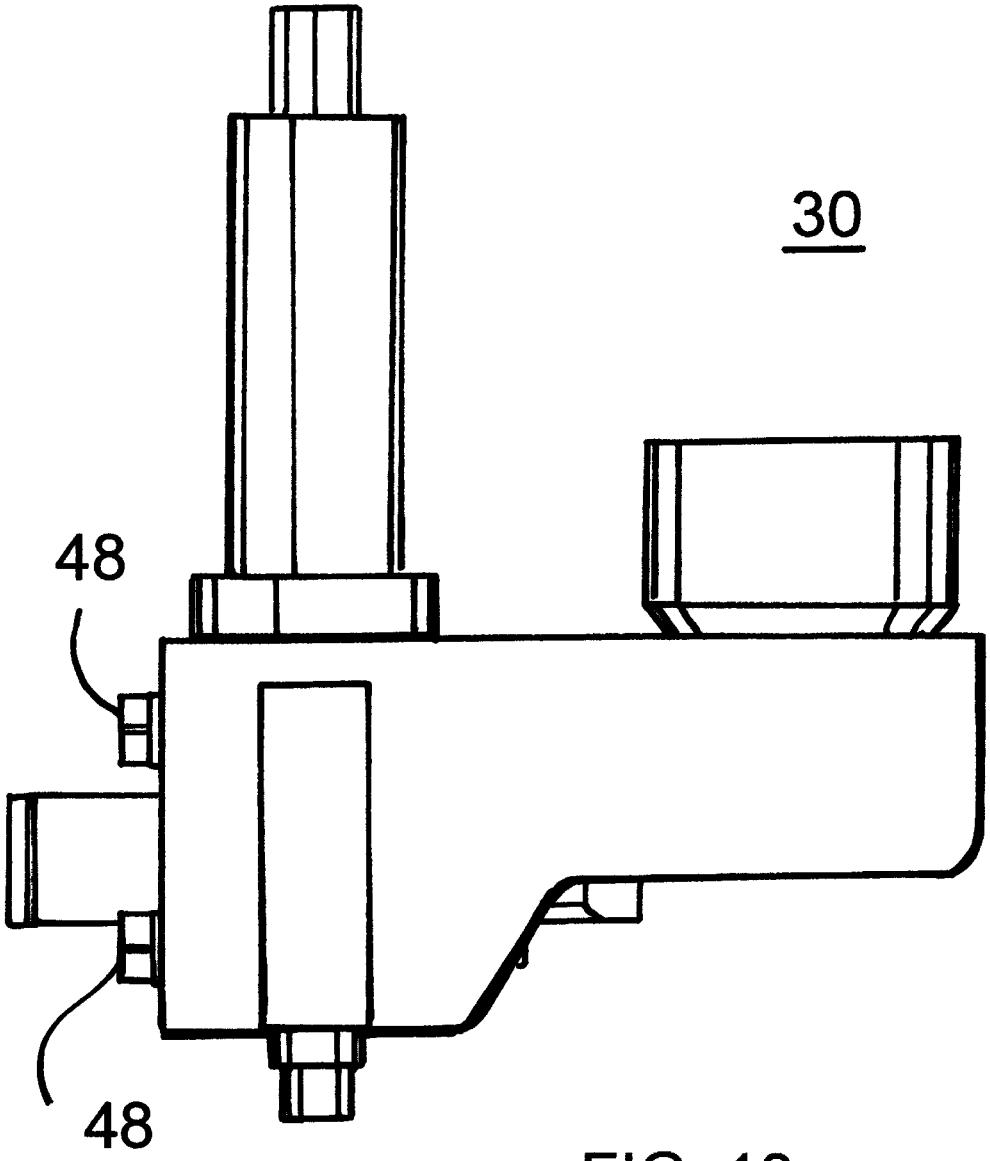
Figure 11:
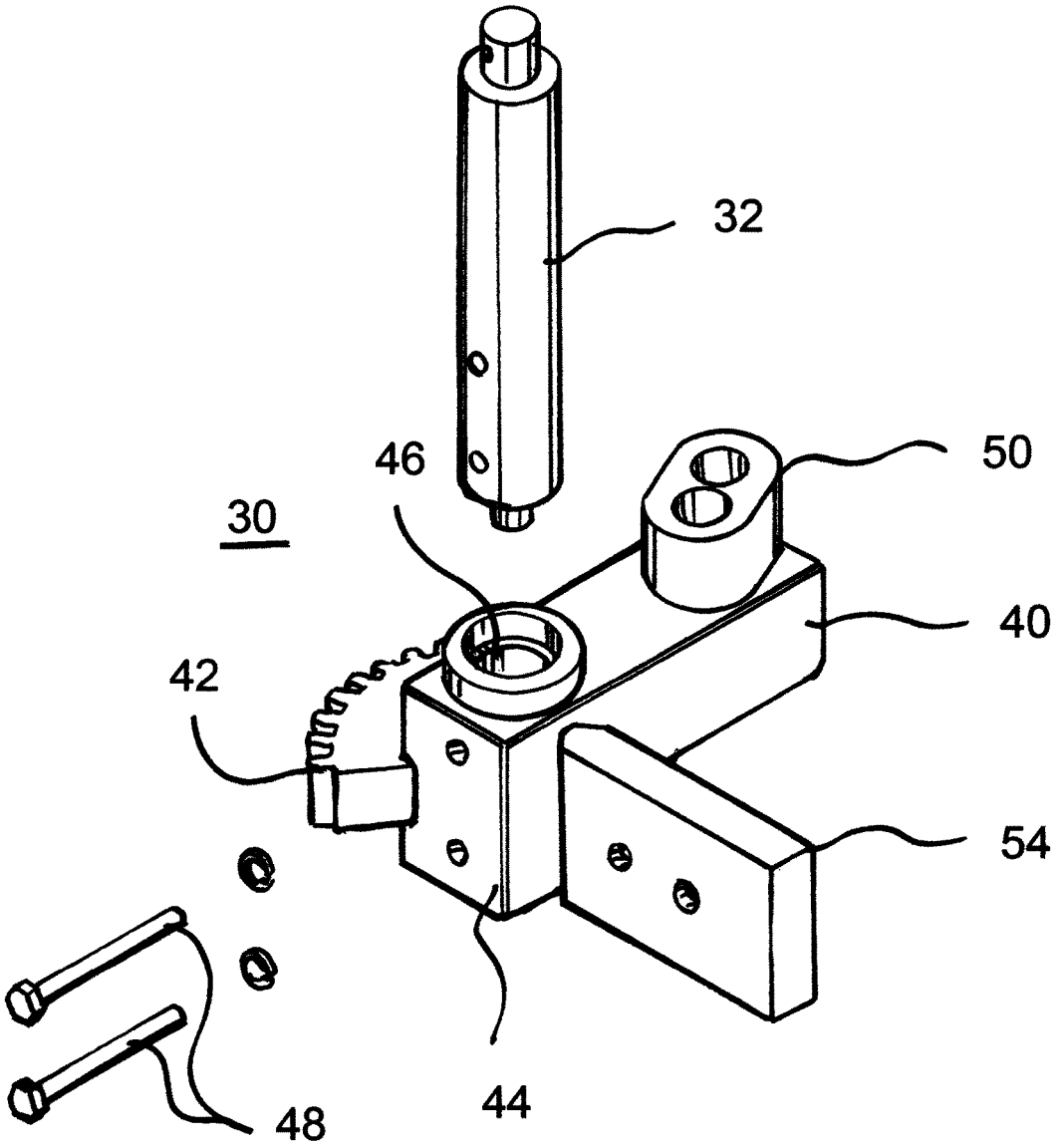
FIG. 11 is an explode perspective view of the portion of the bolt-on shaft and gear system illustrated in FIG. 7.

A powered grasping assembly, generally designated 30, is pivotally mounted in bearing block 22 by means of a pivot pin 32 (see FIG. 7). A slave or follower grasping assembly, generally designated 34 is pivotally mounted in bearing block 24 by means of a pivot pin 36. Referring additionally to FIGS. 7-11 enlarged and more detailed views of powered grasping assembly 30 are illustrated. Powered grasping assembly 30 includes a mounting block 40, which has a generally rectangular cross-section in this embodiment but which may have any convenient shape. Pivot pin 32 is fixedly mounted adjacent one end 44 of mounting block 40 by inserting one end in an opening 46 (see FIG. 11) and pinning the end in opening 46 with a pair of bolts 48 that extend through pivot pin 32 and are threadedly engaged in mounting block 40. Pivot pin 32 extends outwardly or upwardly from mounting block 40 sufficiently to pass through bearing block 22 and to be locked in place (i.e. no longitudinal movement) by a cotter pin 48 or the like (see FIG. 3) extending through an opening in the upper end. Thus, powered grasping assembly 30 is free to rotate on pivot pin 32 within bearing block 22.

A gear section 42 is affixed to mounting block 40 so as to extend outwardly from one side and end 44 coaxial with pivot pin 32. Gear section 42 may be attached to mounting block 40 by any convenient means, such as welding or even integrally formed. A bearing block 50 is affixed to the upper surface of mounting block 40 adjacent the end opposite end 44. An actuating driver 52 is included to controllably pivot or rotate powered grasping assembly 30. In this embodiment driver 52 is a cylinder anchored at one end adjacent to the proximal end of body assembly 14 and the opposite end (in this example the piston, which is operatively engaged in the cylinder) by a bolt 54 extending through bearing block 50. As will be understood, actuating driver 52 can be any of hydraulic, pneumatic, electrical, etc. as dictated by the specific machinery or vehicle to which bolt-on shaft and gear system 10 is attached. A mounting pad 55 is fixedly attached to mounting block 40 and is constructed to receive in operative connection therewith a grasping arm (not shown but generally an arcuate or partially arcuate arm).

Pivot pin 36 of follower grasping assembly 34 has a gear section 60 coaxially mounted thereon and a mounting pad 62 extending radially outwardly from pivot pin 36 generally opposite gear section 60. Two angular metal tabs 64 extend outwardly, one each, from each side of mounting pad 62 in contact with pivot pin 36 and are affixed at the ends to opposite sides of gear section 60. Tabs 64 aid in fixedly supporting and locking gear section 60 and mounting pad 62 to pivot pin 36. With pivot pin 36 pivotally engaged in bearing block 24 gear section 60 is meshed with gear section 42 of powered grasping assembly 30. Mounting pad 55 is constructed to receive in operative connection therewith a grasping arm (not shown but generally an arcuate or partially arcuate arm) and mounting pads 55 and 62 are angularly positioned to cooperate in forming a grasping device.

In operation, actuating driver 52 is energized to rotate powered grasping assembly 30 about pivot pin 32 so that mounting pad 55 is positioned at a desired angle anywhere from a maximum angle to a minimum angle. The maximum angle and the minimum angle are determined primarily by the amount of gear (i.e. the number of teeth) included in gear section 42. It will of course be understood that gear sections 42 and 60 can be any amount of section from a few teeth to a complete gear. Because gear section 42 is meshed with gear section 60, follower grasping assembly 34 is pivoted about pivot pin 36 the same amount but in the opposite direction. Thus, through operation of actuating driver 52 mounting pads 55 and 62 are moved toward and away from each other any desired amount.

Thus, it will be understood that powered grasping assembly 30 can be quickly and easily removed and replaced or repaired by simply disengaging pivot pin 32 from bearing block 22. Similarly, follower grasping assembly 34 can be quickly and easily removed and replaced or repaired by simply disengaging pivot pin 36 from bearing block 24. The entire operation can be performed in a matter of minutes so that the vehicle or other structure is not side-lined or out of operation for any substantial period of time. Also, it should be noted that the novel structure allows very accurate positioning of pivot pins 32 and 36, along with the attached structure, so that accurate alignment is included and, thus, substantially less wear from loose interactions.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A bolt-on shaft and gear system comprising:

a body assembly defining a first and second mount, the first and second mounts are spaced apart from one another;

a powered grasping assembly including a first pivot pin pivotally positioned in the first mount and a first gear section, the first gear section having a gear portion and a mounting block having two ends, one end of the mounting block is removably fixed to the first pivot pin, the first gear portion is directly connected to the mounting block adjacent the first pivot pin, an attachment portion, for coupling with an actuating driver, is connected with the second end of the mounting block, the attachment portion is spaced from the first end of the mounting block connected to the first pivot pin, and the mounting block extending radially outward directly from the first gear portion;

an actuating driver having a first member attached on the body assembly and the actuating driver includes a second member pivotally connected to the attachment portion, spaced from the first pivot pin, of the first gear section of the powered grasping assembly, actuation of the actuating driver, via the connection between the attachment portion of the first gear section and the second member of the actuating driver, moves the first gear section, via the direct connection with the mounting block, for controllably rotating the powered grasping assembly about the first pivot pin, the connection of the actuating driver second member is spaced and separate from the first pivot pin so that the actuating driver drives the first gear section so that, in turn, the first gear section pivots around the first pivot pin; and a follower grasping assembly including a second pivot pin pivotally positioned in the second mount and a second gear section fixedly coupled to the second pivot pin, the second gear section meshing with the first gear section so as to rotate with the powered grasping assembly in an opposite direction.

2. A bolt-on shaft and gear system as claimed in claim 1 wherein the powered grasping assembly further includes a first mounting pad positioned to receive a first grasping arm fixedly attached thereto for rotation with the powered grasping assembly and the follower grasping assembly further includes a second mounting pad positioned to receive a second grasping arm fixedly attached thereto for rotation with the follower grasping assembly.

3. A bolt-on shaft and gear system as claimed in claim 1 wherein the body assembly is elongated with the second mount positioned adjacent a distal end and the first mount positioned between the distal end and a proximal end.

4. A bolt-on shaft and gear system as claimed in claim 3 further including at least one connecting member for attaching the body assembly to a grasping structure including articulated arms connected to a refuse collection vehicle.

5. A bolt-on shaft and gear system as claimed in claim 1 wherein the actuating driver is one of a hydraulic, pneumatic, and electrical driver.

6. A bolt-on shaft and gear system as claimed in claim 1 wherein the powered grasping assembly further includes a mounting block, the first gear section fixedly attached to the mounting block, the first pivot pin removably fixed in the mounting block, and an anchor for attaching the actuating driver.

7. A bolt-on shaft and gear system as claimed in claim 1 wherein the body assembly includes a metal body and a pair of elongate mounting plates affixed to opposite sides of the body, the pair of mounting plates each have a pair of spaced apart openings formed therein positioned to be axially aligned, and body has two spaced apart transversely extending channels formed therein in alignment with the openings in the mounting plates to form the two spaced apart mounts.

8. A bolt-on shaft and gear system comprising:

an elongated body assembly defining first and second spaced apart mounts, the body assembly including a metal body and a pair of elongate mounting plates affixed to opposite sides of the body, the body assembly being constructed with the second of the two mounts positioned adjacent a distal end and the first of the two mounts positioned between the distal end and a proximal end;

a powered grasping assembly including a first pivot pin pivotally positioned in the first mount, a first gear section with a gear portion and an attachment portion, and a mounting block having two ends, one end connected to the first pivot pin, the mounting block fixedly attached to and extending from the gear attachment portion, and the first pivot pin removably fixed in the mounting block;

an actuating driver attached to an anchor on the body assembly and to an anchor on the second end of the mounting block of the powered grasping assembly, the anchor attached on the second end on the mounting block is spaced from the first pivot pin removably fixed in the mounting block, actuation of the actuating driver, via the connection between the mounting block on the attachment portion of the first gear section and the actuating driver anchor attached to the mounting block, moves the first gear section for controllably rotating the powered grasping assembly about the first pivot pin so that a connection of the actuating driver is coupled with the mounting block anchor so that the actuating driver drives the mounting block which, in turn, pivots the first gear section about the first pin; and a follower grasping assembly including a second pivot pin pivotally positioned in the second mount and a second gear section fixedly coupled to the second pivot pin, the second gear section meshing with the first gear section so as to rotate with the powered grasping assembly in an opposite direction.

9. A bolt-on shaft and gear system comprising:

an elongated body assembly defining a first and second spaced apart mounts, the body assembly including a metal body and a pair of elongate mounting plates affixed to opposite sides of the body, the body assembly being constructed with the second mount positioned adjacent a distal end and the first mount positioned between the distal end and a proximal end;

a powered grasping assembly including a first pivot pin pivotally positioned in the first mount, a first gear section with a gear portion and an attachment portion, and a mounting block having two ends, one end connected to the first pivot pin, the mounting block fixedly attached to and extending from the attachment portion of the first gear section, and the first pivot pin being removably fixed in the mounting block;

an actuating driver attached to an anchor on the body assembly and to an anchor on the second end of the mounting block of the powered grasping assembly, the anchor on the mounting block spaced from the first pivot pin removably fixed in the mounting block, actuation of the actuating driver, via the connection between the mounting block on the attachment portion of the first gear section and the actuating driver anchor of the mounting block, moves the first gear section for controllably rotating the powered grasping assembly about the first pivot pin so that a connection of the actuating driver is coupled with the mounting block anchor so that the actuating driver drives the mounting block which, in turn, pivots the first gear section about the first pin, the powered grasping assembly further including a first mounting pad positioned to receive a first grasping arm fixedly attached thereto for rotation with the powered grasping assembly;

a follower grasping assembly including a second pivot pin pivotally positioned in the second mount and a second gear section fixedly coupled to the second pivot pin, the second gear section meshing with the first gear section so as to rotate with the powered grasping assembly in an opposite direction, the follower grasping assembly further including a second mounting pad positioned to receive a second grasping arm fixedly attached thereto for rotation with the follower grasping assembly; and at least one connecting member is mounted on the body assembly for attaching the body assembly to a grasping structure including articulated arms connected to a refuse collection vehicle.

* * * * *